US011078753B2

(12) United States Patent
Werries et al.

(10) Patent No.: US 11,078,753 B2
(45) Date of Patent: Aug. 3, 2021

(54) WELLBORE FLOW CONTROL APPARATUS WITH SOLIDS CONTROL

(71) Applicant: NCS MULTISTAGE INC., Calgary (CA)

(72) Inventors: Michael John Werries, Calgary (CA); Rio Whyte, Calgary (CA); Dustin Ellis, Houston, TX (US)

(73) Assignee: NCS Multistage Inc., Calgary (CA)

( * ) Notice: Subject to any disclaimer, the term of this patent is extended or adjusted under 35 U.S.C. 154(b) by 36 days.

(21) Appl. No.: 16/333,845

(22) PCT Filed: Sep. 15, 2017

(86) PCT No.: PCT/CA2017/051093
§ 371 (c)(1),
(2) Date: Mar. 15, 2019

(87) PCT Pub. No.: WO2018/049533
PCT Pub. Date: Mar. 22, 2018

(65) Prior Publication Data

US 2019/0264533 A1 Aug. 29, 2019

Related U.S. Application Data

(60) Provisional application No. 62/395,776, filed on Sep. 16, 2016.

(51) Int. Cl.
*E21B 34/06* (2006.01)
*E21B 34/14* (2006.01)
(Continued)

(52) U.S. Cl.
CPC ..... *E21B 34/063* (2013.01); *E21B 34/06* (2013.01); *E21B 34/10* (2013.01); *E21B 34/14* (2013.01);
(Continued)

(58) Field of Classification Search
CPC ..... E21B 34/063; E21B 34/10; E21B 34/12; E21B 43/08; E21B 43/088; E21B 43/12
See application file for complete search history.

(56) References Cited

U.S. PATENT DOCUMENTS 3,695,355 A 10/1972 Wood et al.
5,479,989 A 1/1996 Shy et al.
(Continued)

FOREIGN PATENT DOCUMENTS

EP 0427422 A2 5/1991
EP 1423583 B1 3/2006
(Continued)

OTHER PUBLICATIONS

Extended European Search Report; EP 17849974.5 dated Mar. 27, 2020.
(Continued)

*Primary Examiner* — Tara Schimpf

(57) ABSTRACT

A wellbore apparatus to control the flow of fluids into the wellbore, comprising: a housing; a passage disposed within the housing; a flow communicator for allowing communication into the passage; a flow control member; and frangible members releasably retaining the flow control member to the housing in a retained position, and configured, while the apparatus is disposed in an operative orientation, for becoming fractured in response to application of a force in a downhole direction to release the flow control member from the housing such that the flow control member becomes displaceable relative to the flow communicator; wherein: the flow communicator and the flow control member are configured such that, while the apparatus is disposed in the operative orientation within the wellbore, the flow
(Continued)

control member is disposed uphole relative to the retained position while the flow communicator is disposed in the open condition.

20 Claims, 5 Drawing Sheets

(51) Int. Cl.
*E21B 43/08* (2006.01)
*E21B 43/12* (2006.01)
*E21B 34/10* (2006.01)

(52) U.S. Cl.
CPC ..... *E21B 43/088* (2013.01); *E21B 43/12* (2013.01); *E21B 2200/06* (2020.05)

(56) References Cited

U.S. PATENT DOCUMENTS

| | | | | |
|---|---|---|---|---|
| 6,220,357 | B1 * | 4/2001 | Carmichael | E21B 34/10 166/227 |
| 6,276,458 | B1 | 8/2001 | Malone et al. | |
| 6,899,176 | B2 | 5/2005 | Hailey, Jr. et al. | |
| 7,387,164 | B2 | 6/2008 | Pringle et al. | |
| 7,387,165 | B2 | 6/2008 | Lopez de Cardenas et al. | |
| 7,793,716 | B2 | 9/2010 | Macias et al. | |
| 8,127,847 | B2 | 3/2012 | Richard et al. | |
| 8,297,358 | B2 | 10/2012 | Korkmaz et al. | |
| 9,366,123 | B2 | 6/2016 | Fehr et al. | |
| 2002/0020534 | A1 | 2/2002 | Wilson et al. | |
| 2004/0129424 | A1 | 7/2004 | Hosie et al. | |
| 2009/0044944 | A1 | 2/2009 | Murray et al. | |
| 2009/0056934 | A1 | 3/2009 | Xu | |
| 2011/0100643 | A1 | 5/2011 | Themig et al. | |
| 2012/0080188 | A1 | 4/2012 | Richard et al. | |
| 2012/0186803 | A1 | 7/2012 | Xu et al. | |
| 2012/0325466 | A1 | 12/2012 | Themig | |
| 2012/0325500 | A1 | 12/2012 | Moen | |
| 2013/0168099 | A1 | 7/2013 | Themig | |
| 2013/0319687 | A1 | 12/2013 | Huh et al. | |
| 2014/0000909 | A1 | 1/2014 | Neer | |
| 2014/0014347 | A1 | 1/2014 | Adam et al. | |
| 2014/0224471 | A1 | 8/2014 | Coon | |
| 2014/0345876 | A1 | 11/2014 | Coon et al. | |

FOREIGN PATENT DOCUMENTS

| | | | |
|---|---|---|---|
| WO | 2008154184 | A2 | 12/2008 |
| WO | 2018049533 | | 3/2018 |

OTHER PUBLICATIONS

International Search Report and Written Opinion issued in PCT/CA2017/051093 dated Mar. 22, 2018.

International Search Report and Written Opinion issued in PCT/CA2018/050277 dated Sep. 13, 2018.

* cited by examiner

DETAIL "C"
DETAIL "B"
DETAIL "A"
12
11B
11B
15
20
14
16
30
14B
14A 32
11B
11B 14
16
11A
11A
30
14B
14
24
22A
22B
22
12

16
12
34

WELLBORE FLOW CONTROL APPARATUS WITH SOLIDS CONTROL

CROSS-REFERENCE TO RELATED APPLICATIONS

The present application is a national phase application under 35 U.S.C. § 371 of International Application No. PCT/CA2017/051093 filed Sep. 15, 2017, which itself claims priority to U.S. Provisional Patent Application No. 62/395,776 filed Sep. 16, 2016. The contents of each one of these applications is incorporated herein by reference in its entirety without disclaimer.

FIELD

The present disclosure relates to apparatuses which are deployable downhole for controlling production of reservoir fluids from a subterranean formation

BACKGROUND

Production of hydrocarbon reservoirs is complicated by the presence of naturally-occurring solids debris, such as sand, as well as solids, such as proppant, which have been intentionally injected into the reservoir, in conjunction with treatment fluid, for improving the rate of hydrocarbon production from the reservoir.

SUMMARY

In one aspect, there is provided an apparatus for deployment in a wellbore to control flow of formation fluids into the wellbore from a subterranean reservoir, comprising: a housing; a passage disposed within the housing; a flow communicator for effecting, while disposed in an open condition, flow communication between the passage and an environment external to the housing; a flow control member; and one or more frangible interlocking members releasably retaining the flow control member to the housing such that the flow control member is disposed in a retained position, and configured, while the apparatus is disposed in an operative orientation within the wellbore, for becoming fractured in response to application of a sufficient force in a downhole direction such that release of the flow control member from the retention relative to the housing is effected such that the flow control member becomes displaceable relative to the flow communicator; wherein: the flow communicator and the flow control member are co-operatively configured such that, while the apparatus is disposed in the operative orientation within the wellbore, the flow control member is disposed uphole relative to the retained position while the flow communicator is disposed in the open condition.

In another aspect, there is provided a method of producing hydrocarbon-comprising material from a subterranean formation via a wellbore extending into the subterranean formation, comprising: applying a downhole force to a flow control member that is releasably retained to a housing, in a retained position, with one or more frangible interlocking members, such that: (i) fracturing of the one or more frangible interlocking members is effected such that the flow control member is released from the retention relative to the housing, and (ii) the flow control member is displaced downhole until the flow control member becomes disposed in contact engagement with a hard stop such that further downhole displacement is prevented or substantially prevented; and after the flow control member has become disposed in contact engagement with the hard stop, displacing the flow control member in an uphole direction such that opening of a flow communicator is effected for effecting flow communication between the wellbore and the subterranean formation.

In another aspect, there is provided an apparatus for deployment in a wellbore to control flow of formation fluids into the wellbore from a subterranean reservoir, comprising: a housing; a passage disposed within the housing; a flow communicator for effecting, while disposed in an open condition, flow communication between the passage and an environment external to the housing; a flow control member displaceable relative to the flow communicator, along the central longitudinal axis of the passage, for effecting flow control via the flow communicator; wherein the flow communicator has a dimension, measured along an axis that is parallel to the central longitudinal axis of the passage, that is at least one (1) foot.

In yet another aspect, there is provided an apparatus for deployment in a wellbore to control flow of formation fluids into the wellbore from a subterranean reservoir, comprising: a housing; a passage disposed within the housing; a flow communicator for effecting, while disposed in an open condition, flow communication between the passage and an environment external to the housing; a flow control member; one or more frangible interlocking members releasably retaining the flow control member to the housing such that the flow control member is disposed in a retained position, and configured for becoming fractured in response to application of a sufficient force in a downhole direction such that release of the flow control member from the retention relative to the housing is effected such that the flow control member becomes displaceable relative to the flow communicator; wherein, while the flow control member is disposed in the retained position, the flow communicator is disposed in a closed condition, such that flow communication between the passage and the environment external to the housing, via the flow communicator, is prevented or substantially prevented; and a hard stop; wherein: the hard stop and the flow communicator are co-operatively configured such that, while the apparatus is disposed in an operative orientation within the wellbore, the hard stop is disposed downhole relative to the flow communicator for preventing, or substantially preventing, downhole displacement of the flow control member, relative to the flow communicator, after release of the flow control member from the retention relative to the housing; the flow control member, the hard stop, and the flow communicator are co-operatively configured such that, while the apparatus is disposed in the operative orientation within the wellbore and the flow control member is disposed in contact engagement with the hard stop in a downhole displacement prevention position such that the downhole displacement of the flow control member relative to the flow communicator is prevented or substantially prevented, the flow communicator is disposed in the closed condition such that flow communication between the passage and the environment external to the housing, via the flow communicator, is prevented or substantially prevented; the flow communicator has a dimension, measured along an axis that is parallel to the central longitudinal axis of the passage, that is greater than the distance between the retained position and the downhole displacement prevention position, as measured along the central longitudinal axis of the passage; the distance between the retained position and the downhole displacement prevention position, as measured along the central longitudinal axis of the passage, is less than six (6) inches; the dimension of the flow communicator, as measured along an axis that is parallel to the central longitudinal axis of the passage, is at least one (1) foot; and the flow control member and the flow communicator are co-operatively configured such that, while the apparatus is disposed in the operative orientation within the wellbore, the opening of the flow communicator is effectible by displacement of the flow control member, relative to the flow communicator, to an open position that is uphole relative to the retained position, after releasing of the flow control member from the retention relative to the housing.

BRIEF DESCRIPTION OF DRAWINGS

The preferred embodiments will now be described with the following accompanying drawings, in which.

DETAILED DESCRIPTION

Figures 1, 1A, 1B, 1C:
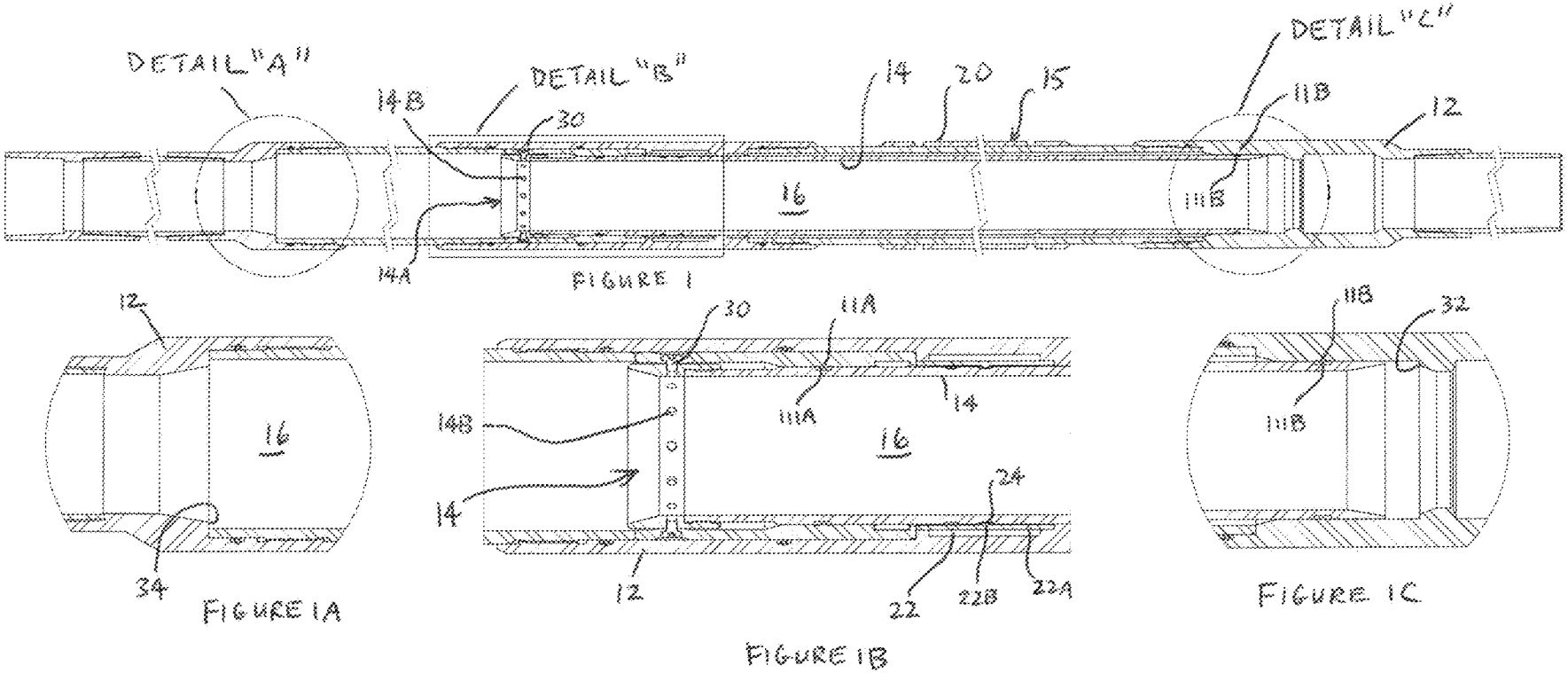
FIG. 1 is a sectional view of a first embodiment of the apparatus, showing the flow control member disposed in the closed position.
FIG. 1A is a detailed view of Detail A in FIG. 1.
FIG. 1B is a detailed view of Detail B in FIG. 1.
FIG. 1C is a detailed view of Detail C in FIG. 1.

There is provided an apparatus 10 for selectively communicating with a subterranean formation 100, such as a reservoir, for effecting production of hydrocarbon material from the reservoir. The apparatus is deployable within a wellbore 8 (see FIG. 5). Suitable wellbores include vertical, horizontal, deviated or multi-lateral wells. The wellbore 8 extends into a subterranean formation 100.

The apparatus 10 is integratable within a wellbore string 11 that is configured for disposition within the wellbore 8. Successive apparatuses 10 may be spaced from each other such that each apparatus is positioned adjacent a producing interval to receive production.

Figure 4:
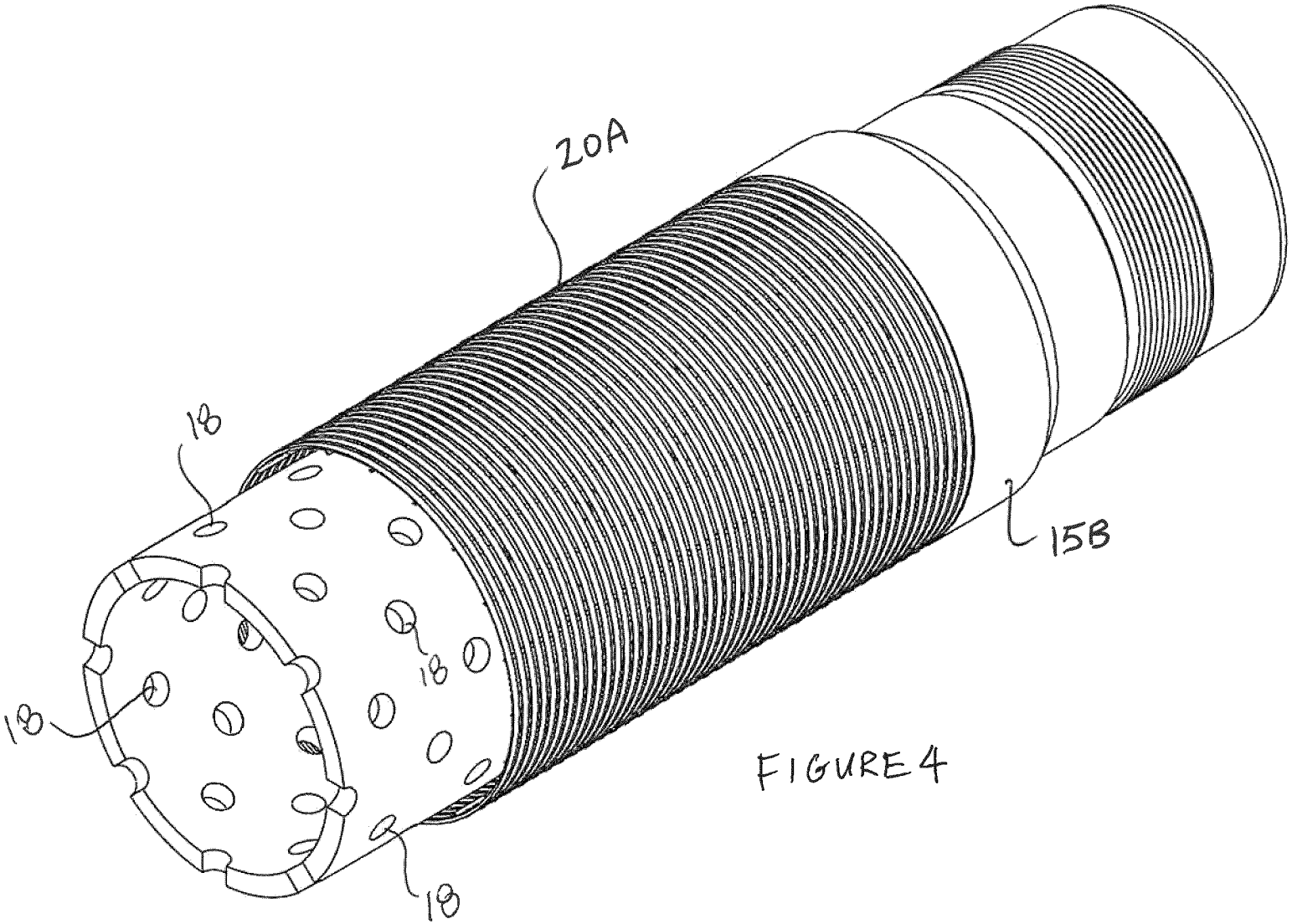
FIG. 4 is a schematic illustration of a partially completed embodiment of the screened port of the apparatus illustrated in FIG. 1, showing screen having been wrapped around a portion of a perforated base pipe.

Referring to FIG. 1, in some embodiments, for example, the apparatus 10 includes a housing 12. The housing 12 includes a flow communicator 15. In some embodiments, for example, the flow communicator 15 is a screened flow communicator that includes one or more one or more apertures or ports 18 (see FIG. 4). Each one of the one or more apertures 18 extends through the housing 12. For each one of the one or more apertures 18, a filter medium 20 is co-operatively disposed relative to the aperture 18 for allowing flow of fluid through the port but interfering with (for example, preventing or substantially preventing) passage of oversize solid particulate matter through the aperture 18. In some embodiments, for example, the filter medium is in the form of a screen, such as a wire screen. In some embodiments, for example, the filter medium 20 is defined by a sand screen 20A that is wrapped around a perforated section of a base pipe 15B, the perforated section defining a plurality of apertures 18, as illustrated in FIG. 4. In some embodiments, for example, the filter medium 20 is in the form of a porous material that is integrated within the aperture 18.

Figure 5:
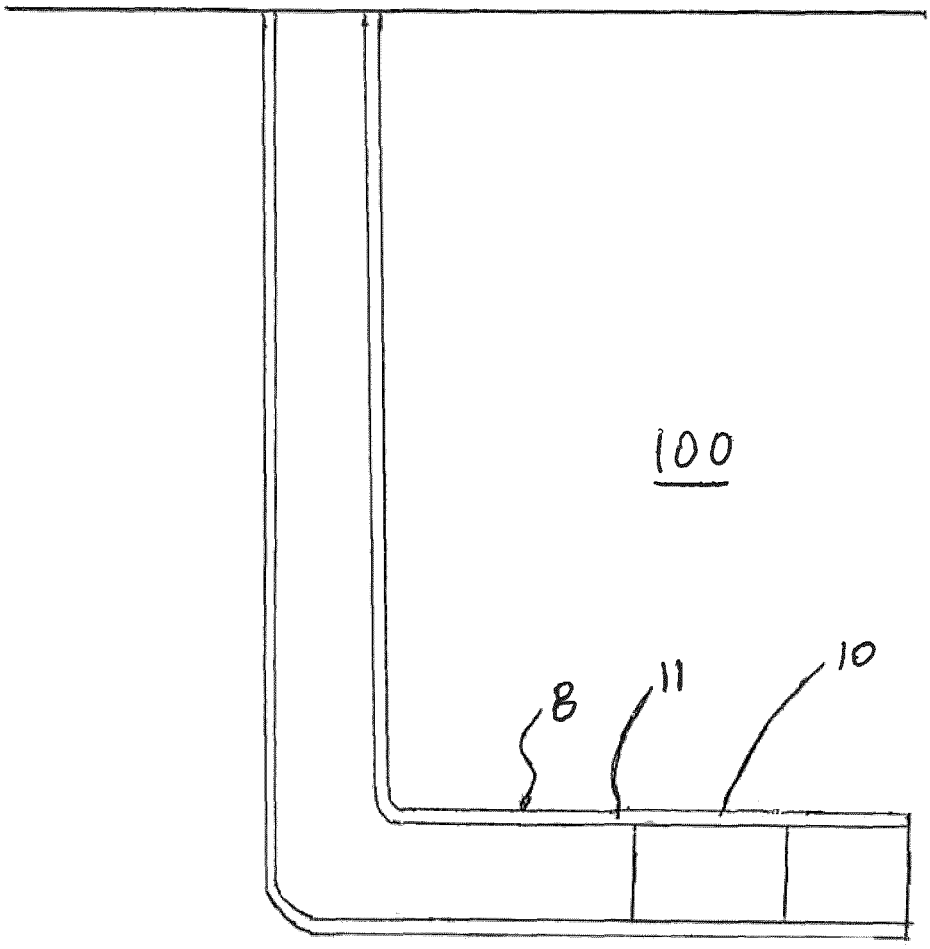
FIG. 5 is a schematic illustration of the integration of the apparatus illustrated in FIG. 1 within a wellbore string that is disposed within a wellbore.

Referring to FIG. 5, the housing 12 is configured for coupling (such as, for example, by threaded connection) to the wellbore string 11. The wellbore string is lining the wellbore 8. The wellbore 11 string is provided for, amongst other things, supporting the subterranean formation 100 within which the wellbore 8 is disposed. The wellbore string 11 may include multiple segments, and segments may be connected (such as by a threaded connection). In some embodiments, for example, the wellbore string includes a casing string.

In some embodiments, for example, it is desirable to seal an annulus, that is formed within the wellbore, between the casing string and the subterranean formation. To prevent, or at least interfere, with conduction of the formation fluid through the annulus, and, perhaps, to a portion of the subterranean formation that is desired to be isolated from the formation fluid, or, perhaps, to the surface, the annulus is filled with a zonal isolation material. In some embodiments, for example, the zonal isolation material includes cement, and, in such cases, during installation of the assembly within the wellbore, the casing string is cemented to the subterranean formation 100, and the resulting system is referred to as a cemented completion.

To at least mitigate ingress of cement during cementing, and also at least mitigate curing of cement in space that is in proximity to the screened flow communicator 15, or of any cement that has become disposed within the port, prior to cementing, the port may be filled with a viscous liquid material having a viscosity of at least 100 mm2/s at 40 degrees Celsius. Suitable viscous liquid materials include encapsulated cement retardant or grease. An exemplary grease is SKF LGHP 2TM grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

A passage 16 is defined within the housing 12. The passage 16 is configured for conducting reservoir material that is received via the screened flow communicator 15 (the reservoir material includes fluid and any undersize solid particulate matter that has passed through the filter medium 20).

The apparatus 10 also includes a flow control member 14. The flow control member 14 is displaceable, relative to the screened flow communicator 15, between a closed position and an open position.

Referring to FIGS. 1, 1A, 1B, and 1C, when the flow control member 14 is disposed in the closed position, in some embodiments, for example, the screened flow communicator 15 is disposed in a closed condition, and in the closed condition, there is an absence, or substantial absence of fluid communication between the passage 16 and the subterranean formation via the screened port. In other words, fluid communication between the passage 16 and the subterranean formation via the screened flow communicator 15 is prevented or substantially prevented.

Referring to FIGS. 3, 3A, 3B, and 3C, when the flow control member 14 is disposed in the open position, in some embodiments, for example, the flow communicator 15 is disposed in an open condition, and in the open condition, the flow communicator 15 is effecting flow communication between the passage 16 and an environment external to the housing 12, such as the subterranean formation. In some embodiments, for example, while the flow communicator 15 is disposed in the open condition, there is an absence of occlusion of any portion, or substantially any portion, of the port by the flow control member; In some embodiments, for example, the disposition of the flow control member 14 in the open position is such that the entirety, or substantially the entirety, of the screened flow communicator 15 is non-occluded by the flow control member 14.

In some embodiments, for example, the flow control member 14 and the flow communicator 15 are co-operatively configured such that, while the flow control member 14 is disposed in the closed position, the resistance to fluid flow through the flow communicator 15 is greater than the resistance to fluid through the flow communicator 15 while the flow control member 14 is disposed in the open position, by a multiple of at least two (2). In some embodiments, for example, the multiple is at least three (3), such as, for example, at least four (4), such as, for example, at least five (5).

In some embodiments, for example, the flow control member 14 is displaceable from the closed position to the open position for effecting fluid communication between the subterranean formation and the passage 16 such that reservoir fluids are producible via the wellbore 8.

In some embodiments, for example, the flow control member 14 is displaceable from the open position to the closed position while fluids are being produced from the subterranean formation through the flow communicator 15, and in response to sensing of a sufficiently high rate of water production from the subterranean formation through the flow communicator 15. In such case, moving the flow control member 14 blocks further production through the flow communicator 15.

In some embodiments, for example, the flow control member 14 is displaceable along an axis that is parallel to the central longitudinal axis of the passage 16.

In some embodiments, for example, the flow control member 14 includes a sleeve. The sleeve is slideably disposed within the passage 16.

In some embodiments, for example, the housing 12 includes sealing surfaces 11A, 11B configured for sealing engagement with the flow control member 14. In this respect, in some embodiments, for example, the flow control member 14 includes sealing members 111A, 111B. The flow communicator 15 is disposed between the sealing surfaces 11A, 11B. In some embodiments, for example, when the flow control member 14 is disposed in a position corresponding to the closed position (such that the flow communicator 15 is disposed in the closed condition), each one of the sealing members 111A, 111B, is, independently, disposed in sealing engagement with both of the housing 12 and the flow control member 14 such that a sealed interface is defined. In some embodiments, for example, the sealed interface is defined by a first counterpart and a second counterpart In some embodiments, for example, the first counterpart is defined by the flow control member and the second counterpart is defined by the housing. In this respect, in the illustrated embodiment, the first counterpart includes the sealing members 111A, 111B and the second counterpart includes the sealing surfaces 11A, 11B, such that the sealed interface is defined while the sealing members 111A, 111B are disposed in contact engagement with the sealing surfaces 11A, 11B. It is understood that, alternatively, the sealing members 111A, 111B could be coupled to the housing 12 and the sealing surfaces 11A, 11B could be defined on the flow control member 14, and other combinations are also possible. While the sealed interface is defined, flow communication between the passage 16 and the subterranean formation, via the flow communicator 15, is sealed or substantially sealed.

In some embodiments, for example, each one of the sealing members 111A, 111B, independently, includes an o-ring. In the illustrated embodiment, for example, the o-ring is housed within a recess formed within the flow control member 14. In some embodiments, for example, each one of the sealing members 111A, 111B, independently, includes a molded sealing member (i.e. a sealing member that is fitted within, and/or bonded to, a groove formed within the sub that receives the sealing member).

In some embodiments, for example, the flow control member 14 co-operates with the sealing surfaces 11A, 11B to effect opening and closing of the flow communicator 15. While the screened flow communicator 15 is disposed in the closed position, the flow control member 14 is sealingly engaged to both of the sealing surfaces 11A, 11B. While the flow communicator 15 is disposed in the open condition, the flow control member 14 is spaced apart or retracted from at least one of the sealing surfaces (referring to FIG. 3, in the illustrated embodiment, this would be the sealing surface 11B), thereby providing a passage for reservoir material to be conducted to the passage 16 via the flow communicator 15.

In some embodiments, for example, a flow control member-engaging collet 22 extends from the housing 12, and is configured to engage the flow control member 14 for resisting a displacement of the flow control member. In some embodiments, for example, the flow control member-engaging collet 22 includes at least one resilient flow control member-engaging collet finger 22A, and each one of the at least one flow control member-engaging collet finger includes a tab 22B that engages the flow control member.

In some embodiments, for example, the flow control member 14 and the flow control member-engaging collet 22 are co-operatively configured such that engagement of the flow control member 14 by the flow control member-engaging collet 22 is effected while the screened flow communicator 15 is disposed in the closed condition.

Referring to FIGS. 1, 1A, 1B, and 1C, while the flow control member 14 is disposed in the closed position (i.e. the flow communicator 15 is disposed in the closed condition) the flow control member-engaging collet 22 is engaging the flow control member 14 such that interference or resistance is being effected to displacement of the flow control member 14. The flow control member 14 includes a closed condition-defining recess 24. The at least one flow control member-engaging collet finger 22A and the recess 24 are co-operatively configured such that, while the flow control member-engaging collet finger tab 22B is disposed within the closed condition-defining recess 24, the flow control member 14 is disposed in the closed position. In order to effect a displacement of the flow control member 14 while the flow control member-engaging collet finger tab 22B is disposed within the closed condition-defining recess 24, a first displacement force is applied to the flow control member 14 to effect displacement of the tab 22B from (or out of) the recess 24. Such displacement is enabled due to the resiliency of the collet finger 22A. Once the flow control member-engaging collet finger tab 22B has become displaced out of the recess 24, continued application of force to the flow control member 14 (such as, in the embodiments illustrated in FIG. 1, in a downhole direction) effects displacement of the flow control member 14, relative to the flow communicator 15.

Figures 2, 2A, 2B, 2C:
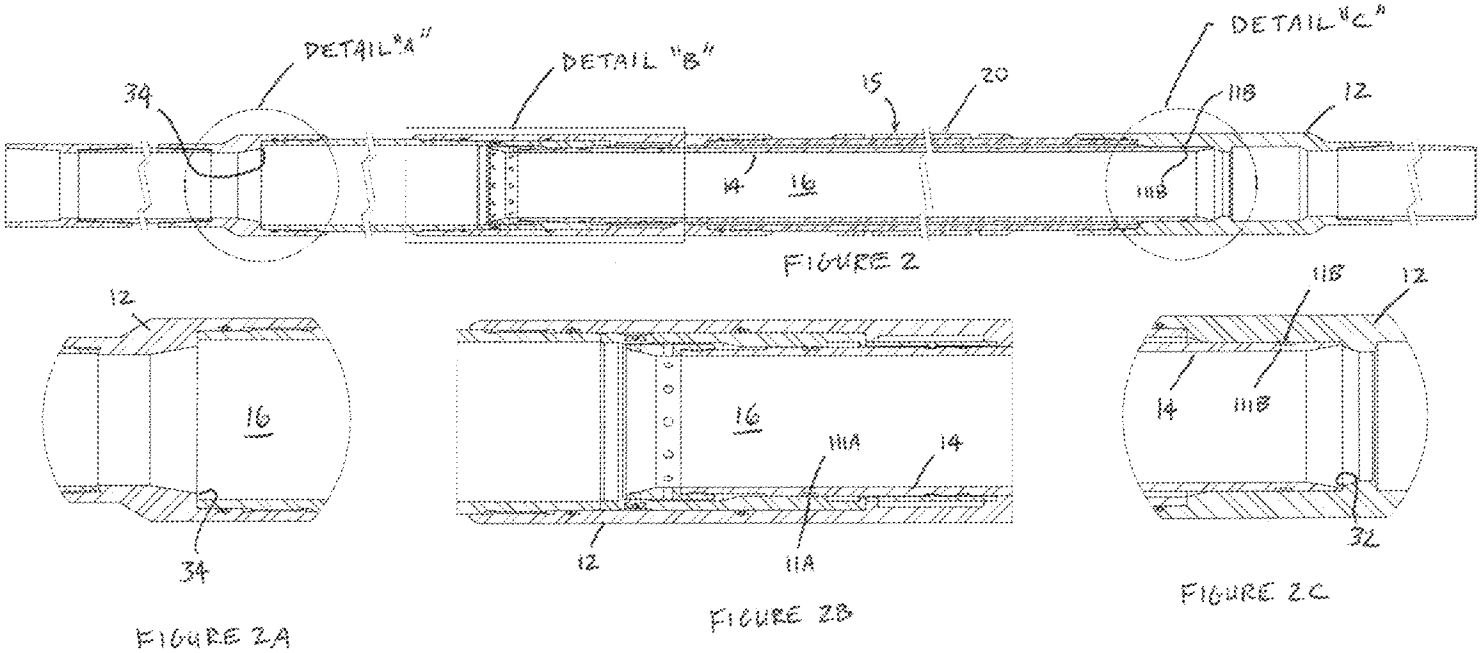
FIG. 2 is a sectional view of the apparatus illustrated in FIG. 1, showing the flow control member disposed in the intermediate position.
FIG. 2A is a detailed view of Detail A in FIG. 2.
FIG. 2B is a detailed view of Detail B in FIG. 2.
FIG. 2C is a detailed view of Detail C in FIG. 2.
Figures 3, 3A, 3B, 3C:
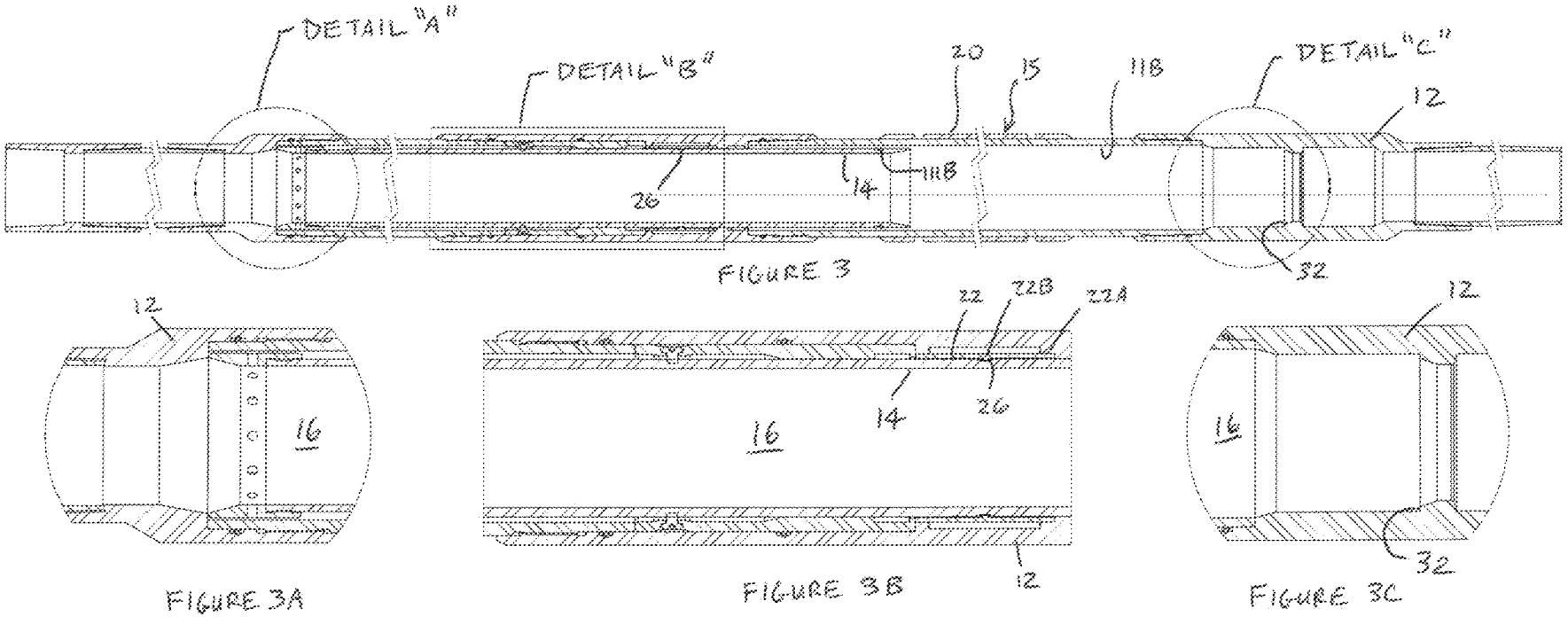
FIG. 3 is a sectional view of the apparatus illustrated in FIG. 1, showing the flow control member disposed in the open position.
FIG. 3A is a detailed view of Detail A in FIG. 3.
FIG. 3B is a detailed view of Detail B in FIG. 3.
FIG. 3C is a detailed view of Detail C in FIG. 3.

Referring to FIGS. 3, 3A, 3B, and 3C, while the flow control member 14 is disposed in the open position (i.e. the flow communicator 15 is disposed in the open condition), the flow control member-engaging collet 22 is engaging the flow control member 14 such that interference or resistance is being effected to displacement of the flow control member 14. The flow control member 14 includes an open condition-defining recess 26. The at least one flow control member-engaging collet finger 22A and the recess 26 are co-operatively configured such that, while the flow control member-engaging collet finger tab 22B is disposed within the open condition-defining recess 26, the screened flow communicator 15 is disposed in the open condition. In order to effect a displacement of the flow control member 14, while the flow control member-engaging collet finger tab 22B is disposed within the open condition-defining recess 26, a second displacement force is applied to the flow control member 14 to effect displacement of the tab from (or out of) the recess 26. Such displacement is enabled due to the resiliency of the collet finger 22A. Once the flow control member-engaging collet finger tab 22B has become displaced out of the recess 26, continued application of the second displacement force to the flow control member 14 (such as, in the embodiment illustrated in FIG. 2, in a downhole direction) effects displacement of the flow control member 14, relative to the screened flow communicator 15.

In some embodiments, for example, the displacement forces are applied to the flow control member 14 mechanically, hydraulically, or a combination thereof. In some embodiments, for example, the applied forces are mechanical forces, and such forces are applied by one or more shifting tools. In some embodiments, for example, the applied forces are hydraulic, and are applied by a pressurized fluid. In those embodiments where the mechanical forces are applied by a shifting tool, in some of these embodiments, for example, the passage 16 is configured to receive the shifting tool for applying mechanical forces to the flow control member 14 to effect the displacement of the flow control member 14.

Referring to FIG. 1, in some embodiments, for example, while the apparatus 10 is being deployed downhole, the flow control member 14 is maintained in the closed position, by one or more frangible interlocking members 30 (such as, for example, shear pins), such that the flow communicator 15 remains disposed in the closed condition. The one or more frangible interlocking members 30 are provided to releasably retain the flow control member 14 to the housing 12 so that the passage 16 is maintained fluidically isolated from the subterranean formation until it is desired to effect hydrocarbon production from the subterranean formation. In some embodiments, for example, the one or more frangible interlocking members 30 extends through apertures 14B provided in a centralizer portion 14A of the flow control member 14.

While the flow control member 14 is releasably retained to the housing by the one or more frangible interlocking members 30, the flow control member 14 is disposed in a retained position. To effect the fracturing (such as, for example, fracturing) of frangible interlocking members 30 such that the flow control member 14 is displaceable relative to the flow communicator 15, sufficient force must be applied to the flow control member 14 such that the one or more frangible interlocking members 30 become fractured, resulting in the flow control member 14 becoming displaceable relative to the screened flow communicator 15. In some operational implementations, the force that effects the fracturing are applied to the flow control member 14 mechanically, hydraulically, or a combination thereof. In the embodiment illustrated in FIG. 1, for example, the force that effects the fracturing is applied in a downhole direction.

In some embodiments, for example, while the flow control member is retained to the housing 12 by the one or more frangible interlocking members 30, the flow control member 14 is positioned in the closed position (such that the flow communicator 15 is disposed in the closed condition). In some embodiments, for example, while the flow control member 14 is retained to the housing 12 by the one or more frangible interlocking members 30, the flow control member 14 is positioned downhole relative to the space occupied by the flow control member 14 while disposed in the open position (i.e. while the flow communicator is disposed in the open condition). In this respect, the flow control member 14 is disposed uphole relative to the retained position while the flow communicator 15 is disposed in the open position.

In such embodiments, for example, the one or more frangible interlocking members 30 are configured for fracturing (such that the flow control member 14 is displaceable relative to the screened flow communicator 15) by application of a sufficient downhole force. Upon the fracturing of the one or more frangible interlocking members 30, the flow control member 14 becomes released from the retention relative to the housing 12, and continued application of the downhole force effects displacement of the flow control member 14 in a downhole direction. If the downhole force were permitted to continue to effect the displacement of the flow control member 14 in a downhole direction, the flow control member 14 would continue to accelerate, and attain a sufficiently high speed, such that, upon rapid deceleration of the flow control member 14 caused by an obstruction to its downhole displacement (such as by a hard stop), associated components become vulnerable to damage. In this respect, the displacement of the flow control member 14 in a downhole direction, that is effected after the fracturing of the one or more frangible interlocking members 30, is limited by a hard stop 32 that extends from the housing 12 and into the passage 16. While the flow control member 14 is disposed in contact engagement (such as, for example, in an abutting relationship) with the hard stop 32, the flow control member is disposed in a downhole displacement prevention position. The distance that the flow control member 14 is permitted to travel (by virtue of the hard stop 32), after having become released from the housing 12 upon the fracturing of the frangible interlocking members, is sufficiently short such that the speed attained by the flow control member 14 is sufficiently slow such that there is an absence of mechanical damage to associated components upon engagement of the hard stop 32 by the flow control member 14 (see FIGS. 2, 2A, 2B, and 2C).

Relatedly, in those embodiments where the flow communicator 15 has a dimension, measured along an axis that is parallel to the central longitudinal axis of the passage 16, that is greater than the distance between the retained position and the downhole displacement prevention position, as measured along the central longitudinal axis of the passage, then the flow communicator 15 is positioned uphole relative to the space occupied by the flow control member 14, while the flow control member 14 is retained to the housing 12 by the one or more frangible interlocking members 30, such that opening of the screened flow communicator 15 is effectible, after the flow control member 14 has become engaged to the hard stop 32, by sufficient uphole displacement of the flow control member 14 relative to, and beyond, the flow communicator 15. Otherwise, if the flow communicator 15 were to be located downhole relative to the space occupied by the flow control member 14, while the flow control member 14 is retained to the housing 12 by the one or more frangible interlocking members 30, and, in complementary fashion, the hard stop 32 were to be positioned further downhole so as to permit sufficient downhole displacement of the flow control member 14 to effect the opening of the flow communicator 15, then the speed attainable by the flow control member 14, while the downhole force continues to be applied after the fracturing of the one or more frangible interlocking members 30, is sufficiently high such that associated components are vulnerable to damage upon the flow control member 14 becoming disposed in contact engagement with the hard stop 32. Similar concerns about component damage are not present while displacing the flow control member 14 in an uphole direction, after the one or more frangible interlocking members 30 having become fractured, as it is easier to maintain a lower applied force to effect such uphole displacement, relative to the flow communicator 15, in these circumstances, relative to the above-described circumstances where the displacement of the flow control member 14, to effect opening of the flow communicator 15, is effected by a downhole force that continues to be applied after having effected the fracturing of the one or more frangible interlocking members 30.

In this respect, in some embodiments, for example, a dimension of the flow communicator 15, measured along an axis that is parallel to the central longitudinal axis of the passage 16, is at least one (1) foot, such as at least three (3) feet, such as at least five (5) feet, or such as, for example, at least eight (8) feet. In some embodiments, for example, a dimension of the screened flow communicator 15, measured along an axis that is parallel to the central longitudinal axis of the passage 16, is ten (10) feet. In some embodiments, for example, the flow communicator 1115 defines an available flow area, through which the flow communication is effectible, of at least 80 square inches, such as, for example, at least 120 square inches, such as, for example, at least 160 square inches, such as, for example, at least 200 square inches. Relatedly, in some embodiments, for example, the distance between the retained position and the downhole displacement prevention position, as measured along the central longitudinal axis of the passage 16, is less than six (6) inches, such as less than three (3) inches, or such as less than two (2) inches. Relatedly, in some embodiments, for example, the distance between the retained position and the open position, as measured along the central longitudinal axis of the passage, is at least one (1) foot.

In some embodiments, for example, it is desirable to mitigate damage to sealing members, associated with the formation of the above-described sealed interface, by portions of the frangible interlocking members 30 that are produced by the fracturing. In this respect, in some embodiments, for example, while the flow control member 14 is being retained to the housing by the one or more frangible interlocking members 30, the one or more frangible interlocking members are disposed uphole relative to the flow communicator 15. Also in this respect, in some embodiments, for example, while the flow control member 14 is being retained to the housing by the one or more frangible interlocking members 30, the one or more frangible interlocking members are disposed uphole relative to the sealing members 111A, 111B that are effecting the sealed interface, and, in this respect, uphole of the sealing members 111A, 111B of the sealing member-embodying counterpart (defined, in the illustrated embodiment, by the flow control member 14) of the counterparts (the first and second counterparts, as above-described) that are configured to define the sealed interface. In such a configuration, after the fracturing of the one or more frangible members 30 by application of a downhole force that effects downhole displacement of the flow control member 14 relative to the flow communicator, because the one or more frangible interlocking members are originally disposed uphole relative to the sealing members 111A, 111B, broken pieces of the one or more frangible interlocking members 30 are less likely to come into contact with the sealing members 111A, 111B, during the subsequent uphole displacement of the flow control member 14 for effecting opening of the flow communicator 15, and thereby damage the sealing members 111A, 111B.

In some embodiments, for example, while the flow control member 14 is disposed in the downhole displacement prevention position, the flow communicator 15 is disposed in the closed condition. In this respect, in some embodiments, it is desirable to release the flow control members 14 of all of the apparatuses 10 within the wellbore string 11 in a single trip in a downhole direction (and then subsequently open the flow communicators 15 of the apparatuses 10 in a single trip uphole), and it is desirable that the flow communicators 15 remain closed while the "releasing" operation is being carried out. In this respect, in some embodiments, for example, the flow communicator 15 is disposed in the closed condition while the flow control member is disposed in the downhole displacement prevention position.

Referring to FIGS. 3, 3A, 3B, and 3C, in some embodiments, for example, the apparatus 10 includes a hard stop 34 for limiting displacement of the flow control member 14, in an uphole direction, relative to the flow communicator 15. In this respect, in some embodiments, for example, while engaged to the hard stop 34, the flow control member 14 is disposed in the open position, such that the flow communicator 15 is disposed in the open condition, and the hard stop 34 determines the open position of the flow control member 14. In this respect, after the flow control member 14 is released from the retention relative to the housing 12 and becomes disposed in the downhole displacement prevention position, opening of the flow communicator 15 is effectible by displacement of the flow control member 14, relative to the flow communicator 15, in an uphole direction in response to an uphole pulling force (such as one imparted by a shifting tool).

In some embodiments, for example, all of the displacement forces are imparted by a shifting tool, and the shifting tool is integrated within a bottom hole assembly that includes other functionalities. The bottomhole assembly may be deployed within the wellbore on a workstring. Suitable workstrings include tubing string, wireline, cable, or other suitable suspension or carriage systems. Suitable tubing strings include jointed pipe, concentric tubing, or coiled tubing. The workstring includes a passage, extending from the surface, and disposed in, or disposable to assume, fluid communication with the fluid conducting structure of the tool. The workstring is coupled to the bottomhole assembly such that forces applied to the workstring are translated to the bottomhole assembly to actuate movement of the flow control member 14.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. An apparatus for deployment in a wellbore to control flow of formation fluids into the wellbore from a subterranean reservoir, comprising:

a housing;

a housing passage disposed within the housing;

a flow communicator for effecting, while disposed in an open condition, flow communication between the housing passage and an environment external to the housing;

a flow control member;

one or more frangible interlocking members releasably retaining the flow control member in retention to the housing such that the flow control member is disposed in a retained position; and a hard stop;

wherein the flow communicator, the flow control member, and the one or more frangible interlocking members are co-operatively configured such that, while the apparatus is disposed in an operative orientation within the wellbore:

the hard stop and the flow control member are co-operatively configured such that the hard stop is disposed downhole relative to the retained flow control member for becoming disposed in contact engagement with the flow control member for preventing, or substantially preventing, downhole displacement of the flow control member relative to the flow communicator after the releasing of the flow control member from the retention relative to the housing;

while the contact engagement of the flow control member and the hard stop is established, the flow control member is disposed in a downhole displacement prevention position and is displaceable, uphole, relative to the flow communicator, to an open position;

while the flow control member is disposed in the open position:

the flow control member is disposed at a location within the housing further uphole relative to the location within the housing at which the flow control member is disposed at while the flow control member is disposed in the retained position;

the distance between the retained position and the downhole displacement prevention position, as measured along the central longitudinal axis of the passage, is less than six (6) inches; and the distance between the retained position and the open position, as measured along the central longitudinal axis of the passage, is at least one (1) foot.

2. The apparatus as claimed in claim 1;

wherein a dimension of the flow communicator, as measured along an axis that is parallel to the central longitudinal axis of the passage, is at least one (1) foot.

3. The apparatus as claimed in claim 2;

further comprising:

a filter medium for preventing passage of oversize solid particulate material through the flow communicator.

4. The apparatus as claimed in claim 3;

wherein the filter medium includes a screen.

5. The apparatus as claimed in claim 1;

wherein:

the flow control member, the hard stop, and the flow communicator are co-operatively configured such that, while the apparatus is disposed in the operative orientation within the wellbore and the flow control member is disposed in contact engagement with the hard stop such that the downhole displacement of the flow control member relative to the flow communicator is prevented or substantially prevented, the flow communicator is disposed in a closed condition such that flow communication between the passage and the environment external to the housing, via the flow communicator, is prevented or substantially prevented.

6. The apparatus as claimed in claim 1;

wherein the one or more frangible members and the flow communicator are co-operatively configured such that, while the apparatus is disposed in the operative orientation within the wellbore, the one or more frangible members are disposed uphole relative to the flow communicator.

7. The apparatus as claimed in claim 6;

wherein:

the flow control member and the housing are co-operatively configured such that, while the flow control member is disposed in a closed position, a sealed interface is defined such that the flow communication between the passage and the environment external to the housing, via the flow communicator, is sealed or substantially sealed;

the sealed interface is defined by a first counterpart, defined by the flow control member, and a second counterpart, defined by the housing, and at least one of the first and second counterparts is a sealing member-embodying counterpart that includes one or more sealing members for effecting the sealed interface, such that at least one sealing member-embodying counterpart is provided; and the one or more frangible members and the at least one sealing member-embodying counterpart are co-operatively configured such that, while the apparatus is disposed in the operative orientation within the wellbore and the one or more frangible members are releasably retaining the flow control member, for each one of the at least one sealing member-embodying counterpart, the one or more frangible members are disposed uphole relative to the one or more sealing members of the sealing member-embodying counterpart.

8. The apparatus as claimed in claim 1;

wherein the flow communicator defines an available flow area, through which the flow communication is effectible, of at least 80 square inches.

9. The apparatus as claimed in claim 8;

further comprising:

a filter medium for preventing passage of oversize solid particulate material through the flow communicator.

10. The apparatus as claimed in claim 9;

wherein the filter medium includes a screen.

11. The apparatus as claimed in claim 1;

wherein a dimension of the flow communicator, as measured along an axis that is parallel to the central longitudinal axis of the passage, is at least three (3) feet.

12. The apparatus as claimed in claim 1;
further comprising:
a filter medium for preventing passage of oversize solid particulate material through the flow communicator.

13. The apparatus as claimed in claim 12;
wherein the filter medium includes a screen.

14. A method of producing hydrocarbon-comprising material from a subterranean formation via a wellbore extending into the subterranean formation, comprising:
applying a downhole force to a flow control member that is releasably retained to a housing, in a retained position, with one or more frangible interlocking members, such that: (i) fracturing of the one or more frangible interlocking members is effected such that the flow control member is released from the retention relative to the housing, and (ii) the flow control member is displaced downhole until the flow control member becomes disposed in contact engagement with a hard stop, in a downhole displacement prevention position, such that further downhole displacement is prevented or substantially prevented; and
after the flow control member has become disposed in contact engagement with the hard stop, displacing the flow control member in an uphole direction such that the flow control member becomes disposed in an open position and opening of a flow communicator is effected for effecting flow communication between the wellbore and the subterranean formation;
wherein:
while the flow control member is disposed in the open position:
the flow control member is disposed at a location within the housing further uphole relative to the location within the housing at which the flow control member is disposed at while the flow control member is disposed in the retained position;
the distance between the retained position and the downhole displacement prevention position, as measured along the central longitudinal axis of the passage, is less than six (6) inches; and
the distance between the retained position and the open position, as measured along the central longitudinal axis of the passage, is at least one (1) foot.

15. The method as claimed in claim 14;
wherein a dimension of the flow communicator, as measured along an axis that is parallel to the central longitudinal axis of the passage, is at least one (1) foot.

16. The method as claimed in claim 15;
further comprising:
a filter medium for preventing passage of oversize solid particulate material through the flow communicator.

17. The method as claimed in claim 14;
wherein:
while the flow control member is disposed in contact engagement with the hard stop such that the downhole displacement of the flow control member relative to the flow communicator is prevented or substantially prevented, the flow communicator is disposed in a closed condition such that flow communication between the wellbore and the environment external to the housing, via the flow communicator, is prevented or substantially prevented.

18. The method as claimed in claim 14;
wherein a dimension of the flow communicator, as measured along an axis that is parallel to the central longitudinal axis of the passage, is at least three (3) feet.

19. The method as claimed in claim 18;
further comprising:
a filter medium for preventing passage of oversize solid particulate material through the flow communicator.

20. The method as claimed in claim 14;
further comprising:
a filter medium for preventing passage of oversize solid particulate material through the flow communicator.

* * * * *